US005586414A

United States Patent [19]

Tawzer

[11] Patent Number: 5,586,414

[45] Date of Patent: Dec. 24, 1996

[54] SYSTEM FOR RESURFACING A ROOF WITH A CANTILEVER EDGE

[75] Inventor: Charles Tawzer, Portland, Oreg.

[73] Assignee: A-1 All Weather Roofing, Inc., Hillsboro, Oreg.

[21] Appl. No.: 191,445

[22] Filed: Feb. 3, 1994

Related U.S. Application Data

[62] Division of Ser. No. 985,024, Dec. 3, 1992, abandoned.

[51] Int. Cl.[6] ..... E04D 13/15

[52] U.S. Cl. ..... 52/57; 52/96; 52/97; 52/199; 52/748.1

[58] Field of Search ..... 52/96, 57, 199, 52/97, 748

[56] References Cited

U.S. PATENT DOCUMENTS

| | | | |
|---|---|---|---|
| 1,184,673 | 5/1916 | Fardon | 52/96 |
| 3,086,324 | 4/1963 | Cheney | 52/96 |
| 3,192,670 | 7/1965 | Jones, III | 52/97 |
| 3,242,622 | 3/1966 | Snead | 52/97 |
| 4,368,604 | 1/1983 | Spielau et al. | 52/309.8 |
| 4,424,650 | 1/1984 | Van Note | 52/96 |
| 4,437,283 | 3/1984 | Benoit | 52/96 |
| 4,519,172 | 5/1985 | Ristow | 52/96 |
| 4,848,045 | 7/1989 | Nichols et al. | 52/96 |
| 4,980,997 | 1/1991 | Tawzer | 52/16 |

*Primary Examiner*—Darnell M. Boucher

*Attorney, Agent, or Firm*—Chernoff, Vilhauer, McClung & Stenzel

[57] ABSTRACT

A system and articles of manufacture for resurfacing a roof having a roof surface with a cantilever portion that extends outward from a roof base. The system comprises an edge strip that covers the cantilever portion and a water impervious sheet that covers the noncantilever portion of the roof. The edge strip and sheet are selected from materials that are heat-weldable to one another, preferably both are made of, or clad with, polyvinyl chloride. The edge strip also has a drip edge that prevents water that runs off the resurfaced roof from running down a wall that supports the roof.

1 Claim, 1 Drawing Sheet

SYSTEM FOR RESURFACING A ROOF WITH A CANTILEVER EDGE

This application is a division, of application Ser. No. 07/985,024, filed Dec. 3, 1992, now abandoned.

BACKGROUND AND SUMMARY OF THE INVENTION

This invention relates to a system for resurfacing a roof with a heat sealable membrane when the existing roofing material cantilevers from the edge of the roof. More particularly, this invention relates to an edge strip for use in such a system that covers the cantilever portion of the existing roofing material.

To improve the appearance of homes having shallow pitch roofs, such as manufactured homes, mobil homes, and modular homes, some manufacturers have installed an asphalt shingle style of roof similar to that found on many custom homes. These roofs comprise a roof base, and the roofing material has a portion which cantilevers outward over an edge of the roof base. However, experience is demonstrating that asphalt shingle roofs are undesirable on shallow pitch roofs because wind-driven water can work its way underneath the shingles and cause the roof to leak. In order to correct the problem of leaking associated with shallow pitch asphalt shingle roofs, many homeowners desire to resurface the roof to make it watertight.

In addition, even on custom built sturdy frame structures, asphalt shingle roofs can only be resurfaced a limited number of times since the weight of multiple layers of roofing material will eventually exceed the loading capability of a structure. When this occurs it is necessary to remove all the existing layers of roofing material and start over. Removing the existing roofing significantly increases the cost of the reroofing job.

Both of these problems with asphalt shingle roofs can be overcome by resurfacing over the existing roofing material with a suitable light-weight, water-impervious material such as polyvinyl chloride (PVC). This roofing material is heat sealable to itself and is installed in elongated overlapping sheets which are sealed to one another. To weatherproof the edges of the roof, the sheets extend beyond the edges of the roof and are attached to a vertical face of the roof base. However, if the existing roofing material extends beyond the edge of the roof base it will create a ragged edge and damage the thin PVC membrane. Thus, the typical method of resurfacing a roof with roofing that cantilevers over an edge is to remove the cantilever portion of the existing roofing material before installing the new materials. However, the step of cutting off that portion is labor intensive, dangerous, and liable to damage other parts of the roof. In addition, asphalt roofing material is not bio-degradable and thus difficult to dispose of.

The present invention provides a solution to the above problems by providing an edge piece for use in a system for resurfacing a roof when the existing roofing has a cantilever portion. The edge strip, which is heat sealable to the resurfacing material, extends over the cantilever portion and provides a watertight and weatherproof exterior. In a preferred embodiment of the present invention the edge strip is molded PVC or a malleable metal, such as aluminum, having a PVC coating. Thus the sheets of PVC that are used to resurface the roof can be heat welded to the edge strip. The edge strip has an upper flat portion that is affixed to the top of the roof and an escutcheon portion that extends downward from the top portion to cover and protect the roofing's cantilever portion. A lower flat portion of the edge strip provides a surface that can be attached to the edge of the roof base or to a support wall. A drip edge is also provided so that water running down the edge piece will drip off and away from the surface to which it is attached.

Accordingly, it is a principle object of the subject invention to provide a system to resurface a roof having a cantilever edge.

It is a further object of the present invention to provide an edge strip for use in a system for resurfacing a roof having a cantilever edge.

DETAILED DESCRIPTION OF THE PREFERRED EMBODIMENTS

Figure 1:
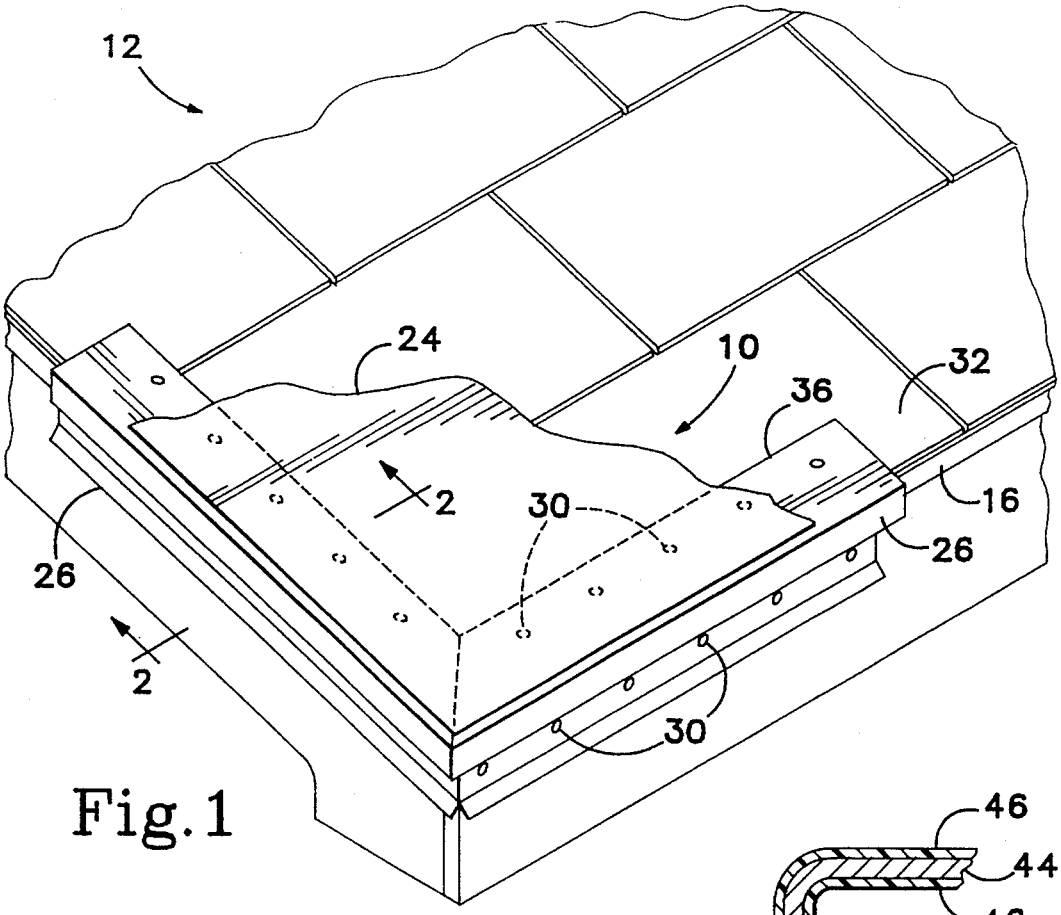
FIG. 1 is a perspective view showing a corner of a partially resurfaced asphalt shingle style roof embodying the subject invention.
Figure 2:
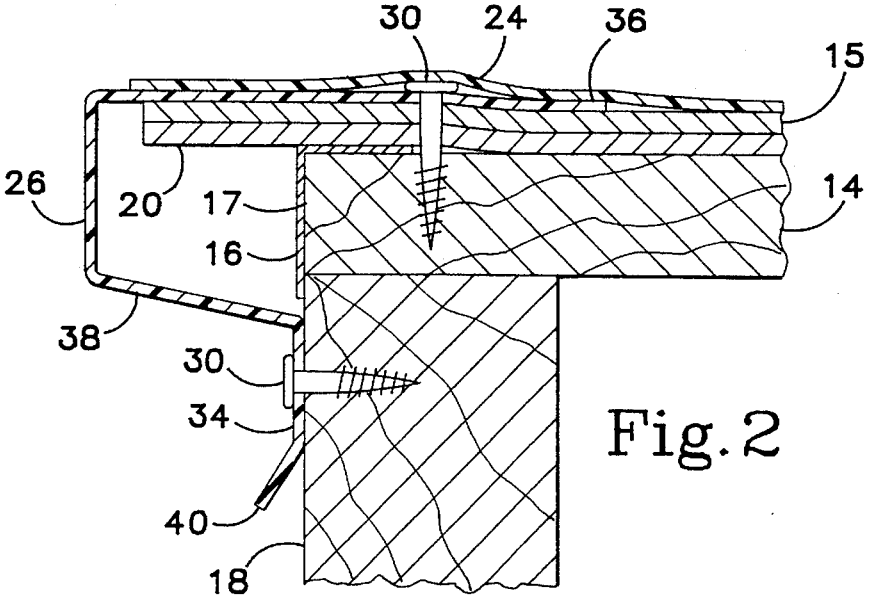
FIG. 2 is a sectional view of the resurfacing system of FIG. 1, taken along line 2—2 on FIG. 1.

Referring to FIGS. 1 and 2, the resurfacing system 10 of the subject invention is shown partially installed on a corner and top surface of an asphalt shingle roof 12. The roof 12 comprises a roof base 14, roofing material 15, and an edge flashing 16 that covers an edge 17 of the roof base. There is a supporting wall 18 that supports the roof base 14. The roofing material 15 has a cantilever portion 20 that extends outward past the roof edge 17. For purposes of illustration the roof base 14 and support wall 18 are shown as a solid wood panel.

The resurfacing system of the present invention is most suitable for resurfacing shallow pitch roofs that have a preexisting asphalt shingle roof 12 with a cantilever portion 20. The resurfacing system of the present invention may also be used with other types of roof construction that have cantilever portions.

The resurfacing system comprises a plurality of sheets of heat-weldable material 24, an edge strip 26, and means for affixing the edge strip to the roof such as fasteners 30. The heat-weldable material 24 can be any suitable material that is impervious to water and heat-weldable to itself. In a preferred embodiment of the present invention, the heat-weldable material 24 is polyvinyl chloride (PVC). Material of this type is commonly used for resurfacing roofs. The material is applied in elongate strips which are oriented perpendicular to the slope line of the roof. The sheets overlap one another and the exposed edge of each sheet is heat sealed to the underlying sheet. In addition, the sheets are attached to the underlying roof along their seams.

Preferably, the edge strip 26 is also made from a heat-weldable material such as PVC. The edge strip 26 comprises a top (or cover) portion 36 designed to overlay the shingle roof 12 along a margin 32 of the roof proximate the roof edge 17. Fasteners 30 are inserted through the top portion 36 of the edge strip to fixedly attach the edge strip to the margin 32 of the roof 12.

The edge strip 26 also has an escutcheon portion 38 that depends downwardly from the top portion 36 to provide a cover over the cantilever roof portion 20 and the roof edge 17. The preferred embodiment of the escutcheon portion comprises two oblique planar surfaces. However, alternative embodiments are envisioned wherein the escutcheon is a smooth, curved surface or configured into an intricate series of planes to represent molding.

At the bottom of the escutcheon portion 38 the edge piece 26 is configured into a surface 34 that may be affixed to the support wall 18 by fasteners 30. The fasteners 30 are inserted through the edge strip 26 into the support wall 18 thereby sealingly connecting the edge strip 26 to the wall. The lower terminal edge of the edge strip 26 angles outward away from the surface of the support wall 18 to provide a drip edge 40 so that water which runs down the surface of the edge strip 26 drips off the edge strip some distance away from the support wall.

Alternatively, the surface 34 could be fastened to the edge 17 over the flashing 16 or to a fascia board.

In the preferred embodiment of the present invention, the edge strip 26 is fabricated from a material that is heat-weldable to the heat-weldable sheets 24 used to cover the main part of the shingle style roof 12 so that the sheets 24 may be heat welded to the edge strip 26 thereby providing a surface that is impervious to water over the entire surface of the roof, around the cantilever portion 20, and the roof's edge 17.

Figure 3:
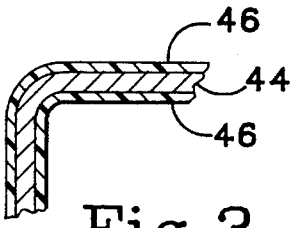
FIG. 3 is a sectional view of a portion of an alternative embodiment of an edge strip of the subject invention.

In an alternative embodiment of the present invention, shown in FIG. 3, the edge strip 26 comprises a malleable metal base 44 that is coated with a heat-weldable material that is compatible with the heat-weldable sheets 24. Preferably, the heat-weldable material of the edge strip 26 or the coating of the alternative embodiment is PVC.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of resurfacing a roof having existing roof material overlying a roof base without first removing the existing roof material from the roof base, comprising:

(a) providing an edge strip having a cover portion, with an outer surface that is heat sealable to polymeric film, which overlies a portion of the existing roof material, an escutcheon portion that depends from the cover portion and a terminal portion that depends from the escutcheon portion and overlies the end of the roof base;

(b) placing said edge strip along an edge of a roof that is covered with existing asphalt singles having a cantilever portion that extends outwardly past the edge of the roof base, with said escutcheon portion wrapping around the cantilever portion so that the cantilever portion does not have to be removed before installing said edge piece;

(c) fastening said edge piece to the roof base along the cover portion and the terminal portion;

(d) thereafter installing polymeric sheet roofing material over the existing shingles with a bottom edge of said material overlying the cover portion of the edge strip; and (e) heat sealing the bottom edge of the polymeric material to the cover portion.

* * * * *